US007293314B2

(12) United States Patent
Henkin et al.

(10) Patent No.: US 7,293,314 B2
(45) **Date of Patent: *Nov. 13, 2007**

(54) TURBINE DRIVE APPARATUS AND METHOD SUITED FOR SUCTION POWERED SWIMMING POOL CLEANER

(75) Inventors: Melvyn L. Henkin, Ventura, CA (US); Jordan M. Laby, Ventura, CA (US)

(73) Assignee: Henkin-Laby, LLC, Ventura, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/509,219

(22) Filed: Aug. 24, 2006

(65) Prior Publication Data

US 2006/0282962 A1 Dec. 21, 2006

Related U.S. Application Data

(63) Continuation of application No. 10/312,748, filed as application No. PCT/US01/14686 on May 8, 2001, now Pat. No. 7,162,763.

(60) Provisional application No. 60/213,976, filed on Jun. 24, 2000.

(51) Int. Cl.
*E04H 4/16* (2006.01)

(52) U.S. Cl. ..... 15/1.7; 15/387; 210/169; 415/202

(58) Field of Classification Search ..... 15/1.7, 15/387; 210/169; 415/202, 203, 53.1, 208.1, 415/211.1, 182.1
See application file for complete search history.

(56) References Cited

U.S. PATENT DOCUMENTS

| | | | |
|---|---|---|---|
| 1,741,379 | A | 12/1929 | Slate |
| 3,229,315 | A | 1/1966 | Watson |
| 3,790,979 | A | 2/1974 | Foster |
| 4,656,683 | A | 4/1987 | Raubenheimer |
| 4,789,364 | A | 12/1988 | Chauvier et al. |
| 4,849,024 | A | 7/1989 | Supra |
| 4,939,806 | A | 7/1990 | Supra |
| 5,105,496 | A | 4/1992 | Gray, Jr. |
| 5,293,665 | A | 3/1994 | Worwag |
| 5,604,950 | A | 2/1997 | Stern |
| 5,701,633 | A | 12/1997 | Jonischus |
| 6,070,547 | A | 6/2000 | Achord |

FOREIGN PATENT DOCUMENTS

| | | |
|---|---|---|
| EP | 0565226 A1 | 10/1993 |
| EP | 0622506 A1 | 11/1994 |

*Primary Examiner*—Mark Spisich
(74) *Attorney, Agent, or Firm*—Freilich, Hornbaker & Rosen

(57) ABSTRACT

A method and apparatus for enabling a pool cleaner to travel through a water pool to collect dirt and other debris from the water and/or pool containment wall. The cleaner defines a suction passageway having an inlet open to pool water and an outlet adapted to be coupled via a flexible hose to the suction side of an electrically driven pump. A resulting suction flow, from the inlet to the pump, functions to (1) carry dirt and other debris to a filter and (2) to drive a turbine for propelling the cleaner. In accordance with the invention, the suction passageway inlet includes an orifice defining a physical flow area A1 and configured to create an "effective" flow area A2 smaller than A1, downstream from the orifice. The small effective flow area A2 creates a water flow of sufficient velocity to efficiently drive the turbine whereas the larger physical flow area A1 permits debris to pass more readily.

6 Claims, 5 Drawing Sheets

TURBINE DRIVE APPARATUS AND METHOD SUITED FOR SUCTION POWERED SWIMMING POOL CLEANER

RELATED APPLICATIONS

This application is a continuation of U.S. application Ser. No. 10/312,748 filed on Dec. 3, 2002 now U.S. Pat. No. 7,162,763 which is a 371 of PCT/US01/14686 filed on May 8, 2001 which claims benefit of U.S. Application 60/213,976 filed on Jun. 24, 2000.

FIELD OF THE INVENTION

This invention relates generally to turbine drive systems and more particularly to a swimming pool cleaner propelled by a turbine driven by a suction powered water flow.

BACKGROUND OF THE INVENTION

Many diverse systems use a pump to pull a fluid (e.g., water) through a suction passageway (typically including a nozzle) in order to drive a turbine. In designing such a system, it is desirable that the passageway define a flow area sufficiently small to produce a fluid velocity sufficiently high to efficiently drive the turbine. However, a relatively small flow area constitutes a flow restriction which, potentially, can obstruct objects (e.g., debris) borne by the fluid. To avoid obstructing the passageway, it would, of course, be preferable that the flow area be as large as possible. These competing design requirements, i.e., (1) reducing flow area to increase fluid velocity and (2) increasing flow area to reduce the potential of flow obstructions, are generally compromised in the design process.

Various efforts intended to mitigate the aforementioned competing requirements are discussed in the prior art. For example, U.S. Pat. No. 4,656,683 describes a suction cleaner for swimming pools in which the suction "nozzle is made of silicone rubber so that it can distend to allow large objects to pass through".

U.S. Pat. No. 5,604,950 describes an anti-clogging variable throat suction cleaning device intended to overcome the disadvantages and shortcomings of the prior art including aforementioned U.S. Pat. No. 4,656,683. More particularly, U.S. Pat. No. 5,604,950 describes a suction nozzle including at least one body portion which is moveable relative to another body portion for the purpose of enabling the throat to expand in response to the relative movement of the body portions. The patent asserts that "The resulting expansion of the suction nozzle allows substantially unrestricted passage of large foreign objects through the throat during the operation of the cleaner".

SUMMARY OF THE INVENTION

The present invention is directed to a suction inlet configured to produce a fluid velocity greater than would be produced by a conventional suction nozzle having an equivalent physical cross section area. The suction inlet in accordance with the invention comprises an orifice whose flow characteristic differs from that of a nozzle in that the constricted section of the flow, i.e., the vena contracta, occurs not within the orifice, but downstream from it. A suction inlet in accordance with the invention is particularly suited for use in a swimming pool cleaner in that it can provide a sufficiently large physical flow area to pass debris such as acorns and rocks which would not fit through a nozzle dimensioned to produce the same fluid velocity for driving a turbine.

The present invention is primarily directed to a method and apparatus for enabling a cleaner to travel through a water pool to collect dirt and other debris from the water and/or pool containment wall. The cleaner defines a suction passageway having an inlet open to pool water and an outlet adapted to be coupled via a flexible hose to the suction side of an electrically driven pump. A resulting suction flow, from the inlet to the pump, functions to (1) carry dirt and other debris to a filter and (2) to drive a turbine for propelling the cleaner.

In accordance with the invention, the suction passageway inlet includes an orifice defining a physical flow area A1 and is configured to create an "effective" flow area A2, smaller than A1, downstream from the orifice. The small effective flow area A2 creates a water flow of sufficient velocity to efficiently drive the turbine whereas the larger physical flow area A1 permits debris to pass more readily. The orifice peripheral edge is typically, though not necessarily, circular.

A preferred cleaner embodiment is comprised of a housing including a wall (or "plate") defining a passageway inlet. The inlet is formed by an orifice extending through the plate which defines an edge peripheral to the orifice. The housing is adapted to be supported in the pool, e.g., on wheels, to place the plate outer surface close to the pool wall surface. This geometry causes water streaming into the orifice to make a sharp directional transition just upstream from the orifice peripheral edge. This transition results in the formation of a vena contracta downstream from the orifice.

The hydrodynamics of an orifice through a plate, resulting in a vena contracta, has been discussed in the literature, primarily with regard to pipeline flow metering (See, e.g., *Elementary Fluid Mechanics* by John K. Vennard, McGraw Hill Book Co., 1949, at pages 250-262). The flow characteristics of an orifice differ from those of a typical nozzle in that the constricted section of the flow occurs not within the orifice, but downstream from it. The term "vena contracta" refers to the contracted downstream cross section of a jet after passing through the orifice. The formation of the vena contracta occurs as a consequence of water converging on the upstream orifice edge from all directions and continuing to converge downstream from the orifice. Where the orifice upstream edge defines a physical flow area A1 and the vena contracta defines an effective flow area A2, the "coefficient of contraction, $C_C$" is expressed as $C_C$=A2/A1. Various orifice edge geometries, e.g., square-edged, sharp-edged, and Borda, are discussed in the literature, and are generally characterized by different coefficients of contraction.

A cleaner in accordance with the present invention preferably employs an orifice having an upstream cross dimension, i.e., diameter, of between 0.25 and 2.0 inches, and a peripheral edge of the same diameter extending axially less than 5% of that diameter. Various orifice geometries can be used including circular, elliptical, etc. Use of the term "diameter" is not intended to limit the scope of acceptable orifice geometries. The orifice can be formed as a square-edged hole through a thin plate or a sharp-edged hole through a thicker plate. Alternative orifice edge geometries can also be used. Regardless of which geometry is used, the effect must be to produce a vena contracta downstream from the orifice having an effective flow area A2 where A2<80% of the physical flow area A1 defined by the orifice upstream peripheral edge.

A preferred cleaner in accordance with the invention utilizes a plate outer surface which is substantially planar adjacent the upstream orifice edge and has an area surrounding the orifice which is at least four times, and preferably ten times, the physical orifice area A1. The turbine is mounted in the cleaner housing close to the vena contracta, i.e., downstream from the orifice.

DETAILED DESCRIPTION

Figure 1:
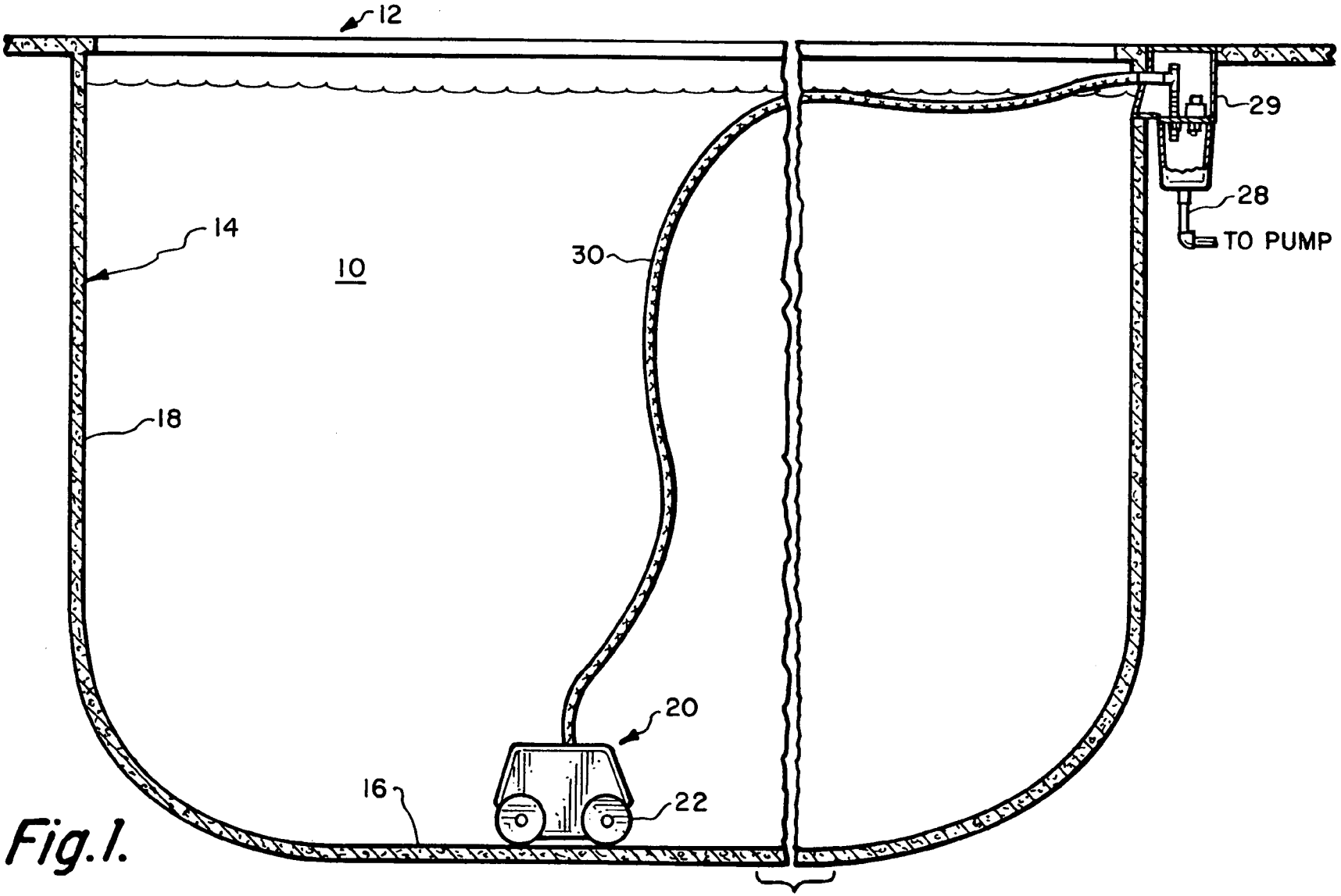
FIG. 1 schematically depicts an exemplary suction powered cleaner in a typical water pool.
Figure 2:
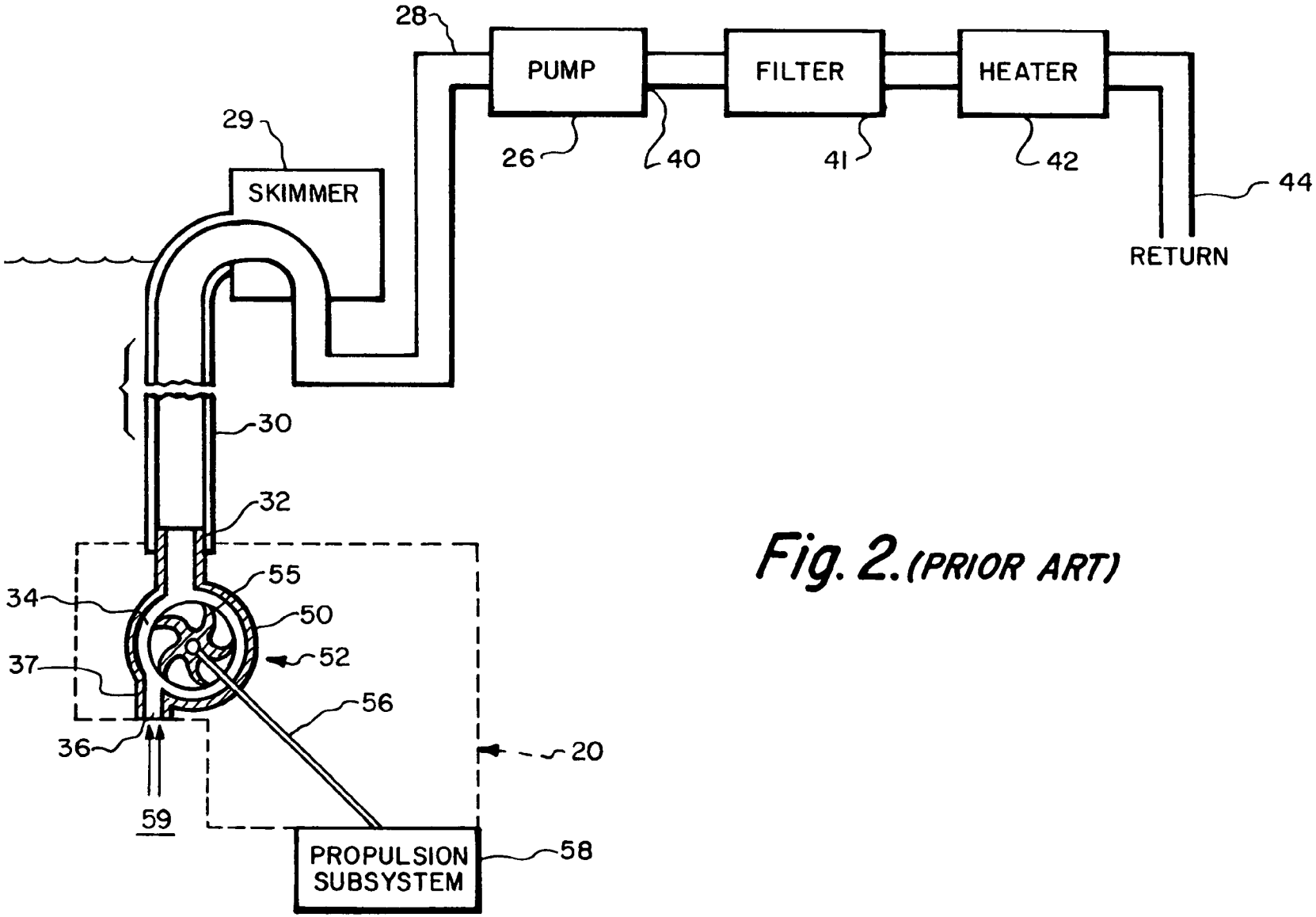
Fig. 2. (PRIOR ART)
FIG. 2 schematically depicts an exemplary cleaner including a turbine driven by a water flow though the cleaner housing produced by suction applied to the cleaner by a external pump.

Attention is now directed to FIG. 1 which illustrates a typical application of an embodiment of the invention for cleaning a water pool 10 contained in an open vessel 12 defined by a containment wall 14 having a bottom wall portion 16 and a side wall portion 18. A cleaner 20 in accordance with the invention is intended to travel through the pool 10, primarily adjacent to the interior surface of wall 14. The cleaner 20 is preferably supported on some type of traction means, e.g., wheels 22, and includes a propulsion subsystem which can drive the traction means and/or otherwise propel the cleaner, e.g., discharge a water stream to produce a reaction force. Power to drive the propulsion subsystem is provided by an external electrically driven pump 26 (FIG. 2). The suction side 28 of the pump is typically coupled via skimmer 29 and flexible hose 30 to an outlet 32 on the cleaner 20. The outlet 32 is coupled via an interior passageway 34 to a water inlet 36, typically comprising a conventional nozzle 37. Suction produced by pump 26 pulls a pool water stream into inlet 36 and through passageway 34 and hose 30 to pump 26. The pressure side 40 of pump 26 typically returns water to the pool via filter 41, heater 42, and return line 44. The pool water stream pulled into inlet 36 functions to collect dirt and other debris from the surfaces of wall portions 16, 18 and additionally is used to drive a turbine which powers a propulsion subsystem carried by the cleaner 20, as depicted in FIG. 2.

More particularly, FIG. 2 schematically illustrates a turbine housing 50 within cleaner 20. The housing 50 defines the aforementioned inlet 36, interior passageway 34, and outlet 32. Outlet 32 is connected by flexible hose 30 to the suction side 28 of pump 26. FIG. 2 also depicts a turbine 52 mounted within the passageway 34. The turbine 52 includes a rotor 55 mounted for rotation to drive an output shaft 56. The output shaft 56 is coupled to a propulsion subsystem 58 carried by the cleaner 20.

The suction applied to outlet 32 by pump 26, via hose 30, draws a water stream 59 into inlet 36. This stream carries water borne debris through the passageway 34 to the pump 26 and filter 41. Additionally the water stream through passageway 34 rotates the turbine rotor 55 to drive the shaft 56 and the propulsion subsystem 58. As previously, noted, the propulsion subsystem 58 can be configured to propel the cleaner 20 in various manners such as by driving wheels 22 and/or by driving a flow generator (not shown) to discharge a water stream into the pool to produce a reaction force.

Figure 3:
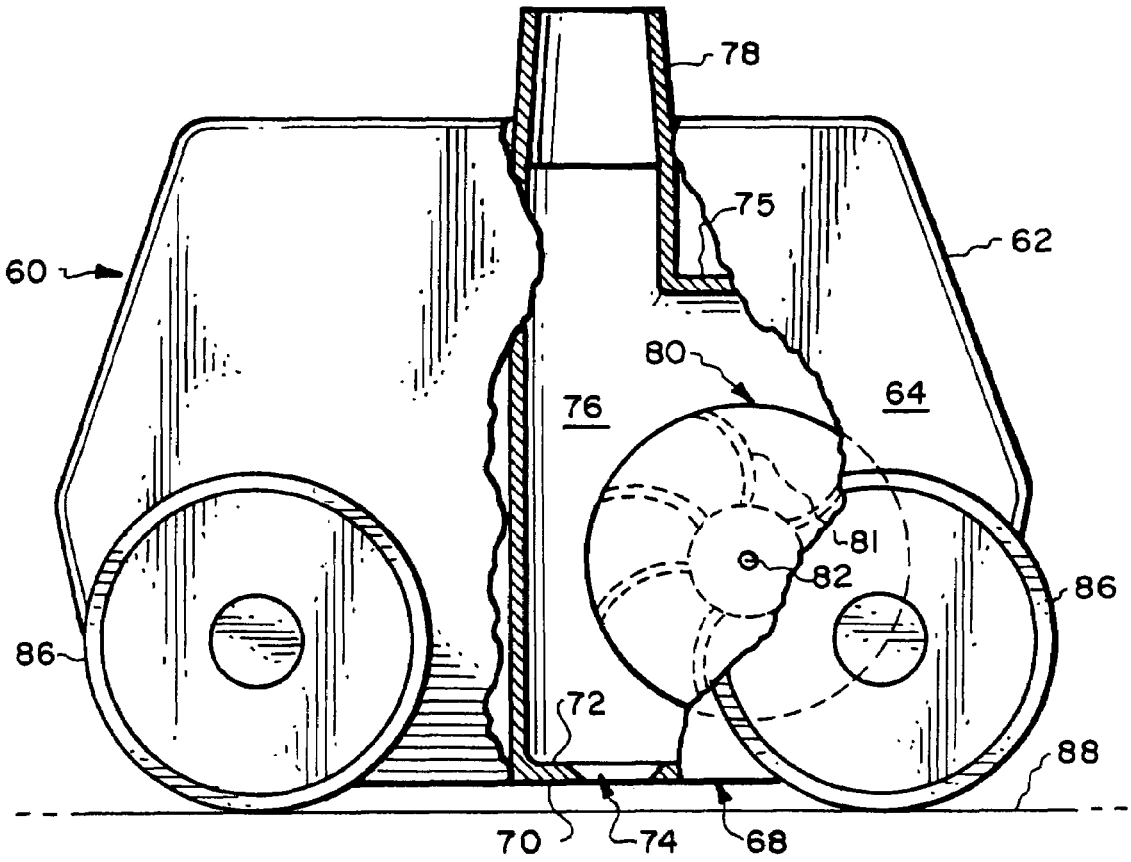
FIG. 3 is side sectional view schematically showing a cleaner in accordance with the present invention for forming a vena contracta in the water flow inlet.
Figure 4:
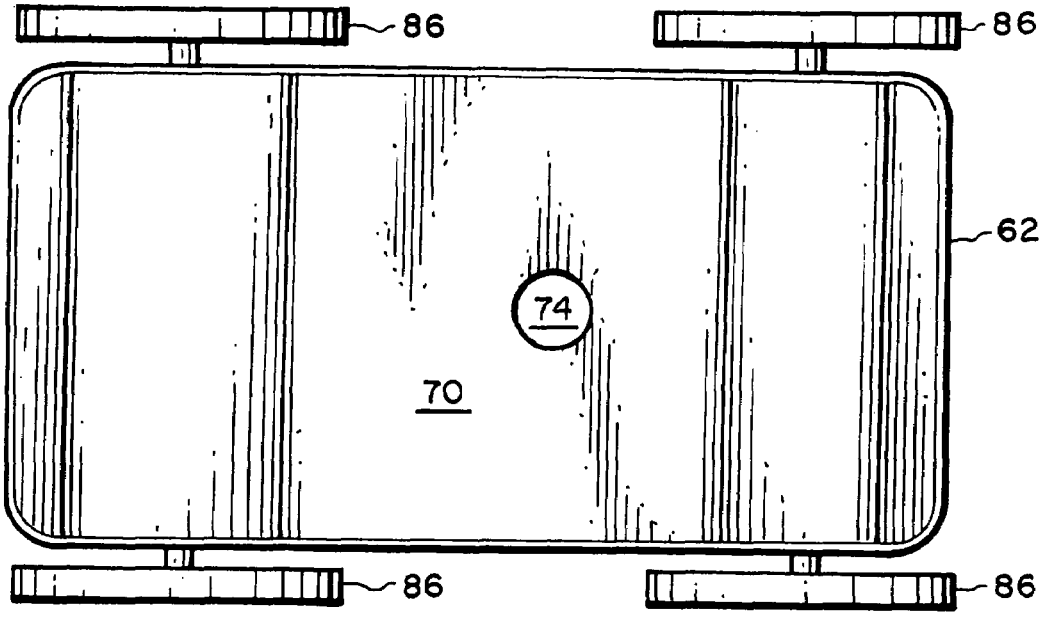
FIG. 4 is a bottom view of the cleaner of FIG. 3.

Attention is now directed to FIGS. 3 and 4 which show a cleaner 60 in accordance with the present invention. The cleaner 60 is comprised of a housing 62 including an exterior wall 64. The bottom portion of wall 64 is configured to define a plate 68 having a substantially planar outer surface 70 and inner surface 72. In accordance with the present invention, an inlet orifice 74 extends through the plate 68 from the outer surface 70 to the inner surface 72. The orifice peripheral edge in plate 68 is typically, though not necessarily, circular. The orifice opens into the interior of a turbine housing 75 defining a passageway 76 coupling the orifice 74 to an outlet fitting 78. The outlet fitting 78 is adapted to be coupled to the suction side of a pump 26, via a flexible hose 30. A turbine rotor 80 having blades 81 is mounted in the passageway 76 for rotation about axis 82.

The cleaner housing 62 is supported on traction means, preferably wheels 86, which engage the pool wall surface 88 and position the plate outer surface 70 close to but spaced from, e.g., 3/16 of an inch, the wall surface 88. The planar outer surface 70 defines an area much larger than the area of orifice 74. For example, if the upstream physical area of orifice 74 is represented by A1, then the planar outer surface 70 surrounding orifice 74 preferably has an area ten times A1. The physical orifice area A1 defines the maximum size debris which can enter the passageway 76. The passageway, as can be seen in the drawings (e.g., FIG. 3), provides an unobstructed path around turbine 80 sufficient (i.e., equal to or greater than A1) to pass debris entering the orifice 74 to the outlet fitting 78 without clogging the turbine. As can also be seen, the outlet fitting is also dimensioned equal to or greater than A1 to pass such debris.

Figure 5B:
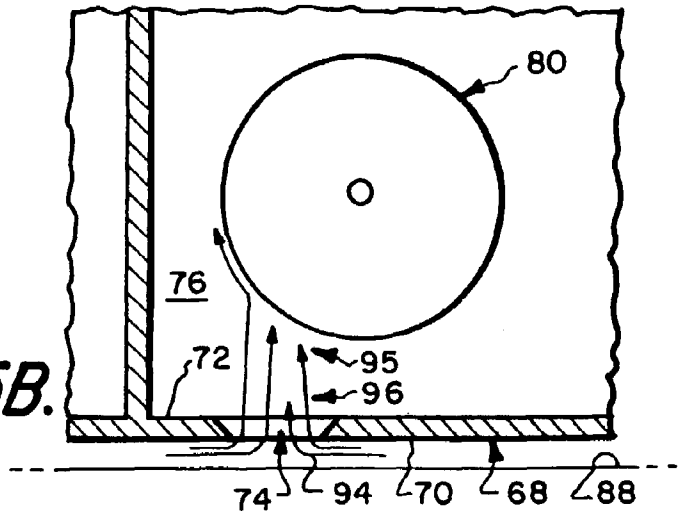
FIGS. 5A and 5B are schematic views showing a sharp-edged orifice in accordance with the invention for forming a vena contracta.
Figure 5A:
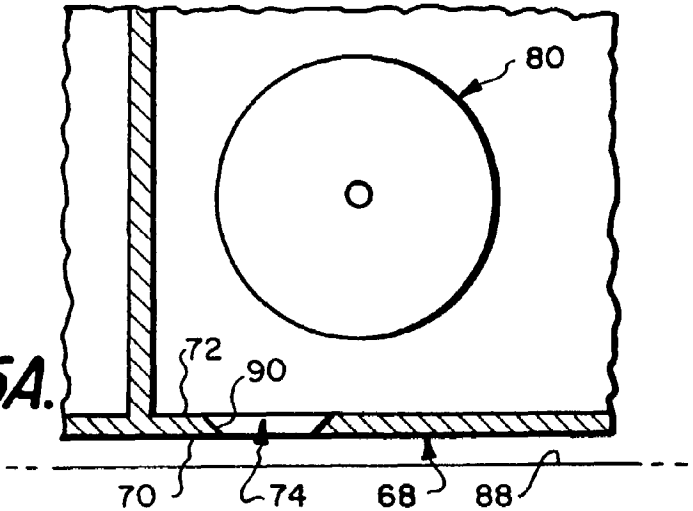

Attention is now directed to FIGS. 5A and 5B which illustrate in greater detail the plate 68 and a sharp edged orifice 74 extending therethrough. Note that the orifice 74 is formed by a peripheral edge 90 defined by the plate 68 extending between outer surface 70 and inner surface 72. The peripheral edge 90 is shown as tapering outwardly at about 45° from the upstream outer surface 70 toward the downstream inner surface 72. Thus, if the upstream dimension of edge 90 is represented by diameter D1, then the downstream dimension D2 is greater than D1. The tapering should preferably begin within an axial distance of 5% of D1 from the upstream orifice edge at the planar surface 70. The edge should be free of visible burrs or rounding.

FIG. 5A depicts orifice edge geometry in greater detail and FIG. 5B depicts the water stream lines 94 which are pulled into orifice 74 from all directions around the orifice. Note that water streams essentially horizontally, parallel to the plane of surface 70, toward the orifice 74 prior to making an abrupt substantially 90° turn into the passageway 76. The effect is to produce a vena contracta 95 in the water jet 96 downstream from the plate surface 72. That is, if the orifice diameter D1 at the outer surface 70 defines an area A1, then the vena contracta effect causes the water jet 96 to contract to an area A2 downstream from the orifice, where A1>A2. The vena contracta typically occurs at a distance of about 1.5 times D1 downstream from the orifice, depending upon the particular geometry. The turbine blades 81 are mounted to be impacted by the water jet 96 proximate to the vena contracta. Thus, the turbine is impacted by a jet having a velocity associated with the smaller effective area A2 whereas debris, e.g., leaves, twigs, etc. see a larger physical area A1. The ratio A2/A1 is less than 0.8 and can be configured to be as small as 0.6. Therefore, the orifice can produce water flow like a small cross section area nozzle and simultaneously have the debris passing ability of a nozzle with a substantially larger cross section area.

Figure 6B:
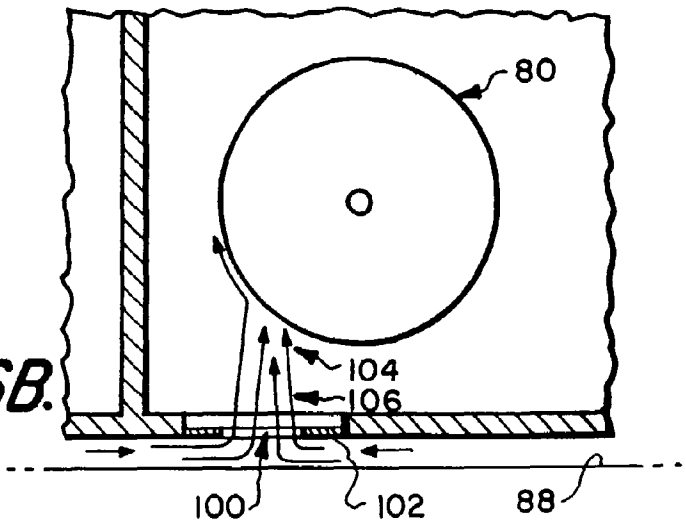
FIGS. 6A and 6B are schematic views showing a thin plate square-edged orifice in accordance with the invention for forming a vena contracta.
Figure 6A:
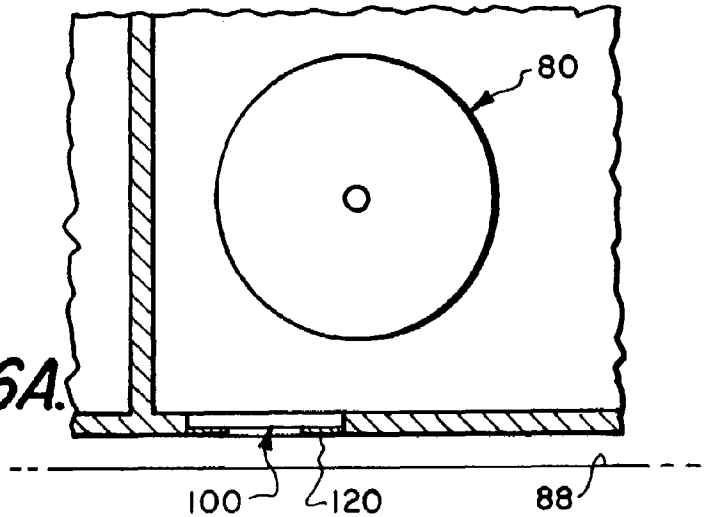
Figure 7B:
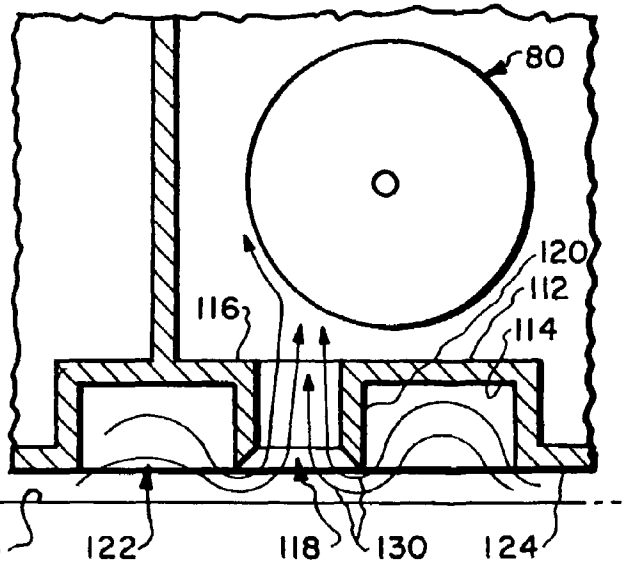
FIGS. 7A and 7B are schematic views showing a Borda type orifice for forming a vena contracta.
Figure 7A:
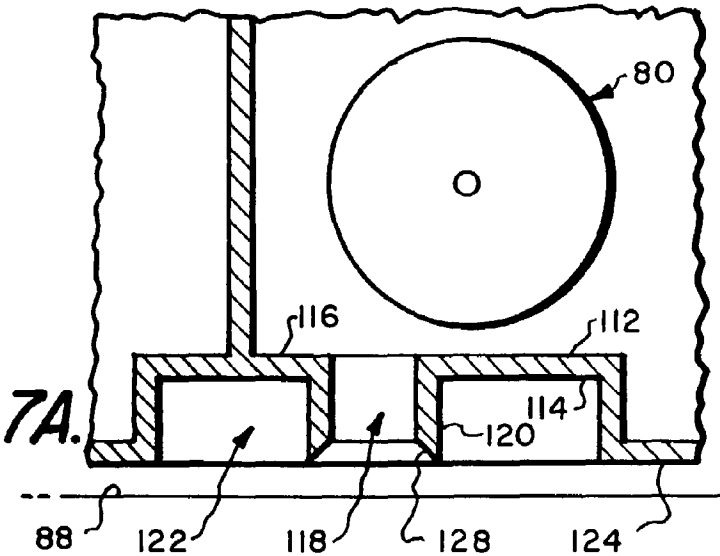

The vena contracta effect created by the sharp-edged orifice illustrated in FIGS. 5A and 5B can also be created by other edge geometries such as a square edged orifice through a thin plate (FIGS. 6A, 6B) or a geometry as depicted in FIGS. 7A and 7B, generally referred to as a Borda orifice.

FIGS. 6A and 6B depict a square-edged orifice 100 extending through a thin plate 102. In order to produce the vena contracta 104 in water stream 106, the plate should preferably have a thickness of less than 5% of the diameter of the orifice. The upstream edge of the orifice should define a 90° corner and be free of visible burrs or rounding. The plate 102 should be flat and smooth and strong enough to resist bulging. For applications in a pool cleaner, the orifice physical diameter regardless of edge geometry, would typically be between 0.25 and 2.0 inches. In a sharp-edged orifice, as in FIGS. 5A and 5B, the plate can be thicker but the orifice edge should taper outwardly preferably within an axial distance equal to about 5% of the orifice upstream diameter.

Figure 8:
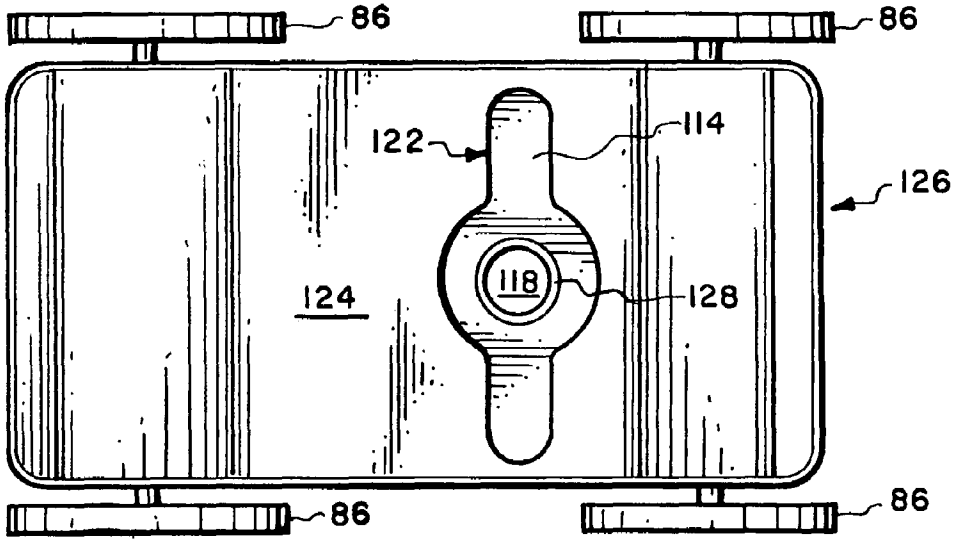
FIG. 8 is a bottom view similar to FIG. 4 but configured to accommodate the Borda orifice of FIGS. 7A and 7B.

FIGS. 7A, 7B and 8 depict an orifice configuration sometimes referred to as a Borda orifice. It is defined by a plate 112 having an outer planar surface 114 and an inner planar surface 116. An orifice 118 extending through the plate 112 is surrounded by a short cylindrical wall 120 extending axially upstream. The wall 120 is surrounded by the substantially planar surface 114, preferably having an area equal to about ten times the area of the orifice 118. The planar surface area 114 is preferably formed within a recess 122 formed in the lower wall 124 of cleaner body 126. The cylindrical wall 120 defines a sharp upstream edge 128 which tapers inwardly. FIG. 7B shows water stream lines 130 which are pulled into orifice 118, making an abrupt transition around edge 128 to form the vena contracta.

It is recognized that the formation of a vena contracta in a turbine drive system as taught herein can be implemented using a variety of different orifice and orifice edge geometries. It is intended that the claims be interpreted to cover all such geometries which provide for a physical flow area A1 through the orifice and a smaller effective water jet area A2 for driving a turbine where A2/A1<0.8.

The invention claimed is:

1. A turbine drive apparatus comprising:

a housing defining a passageway extending between an inlet and an outlet;

said inlet comprising an orifice extending between spaced first and second surfaces of a plate and bounded by a peripheral edge formed by said plate;

said peripheral edge defining a physical cross section area A1;

means for applying suction to said outlet for pulling a fluid stream into said passageway past said peripheral edge and forming a vena contracta defining a stream cross section area A2 downstream from said edge, where A1>A2;

a turbine having blades mounted in said passageway proximate to said vena contracta; and wherein said peripheral edge defines a diameter D1 and said vena contracta occurs at 1.5 times D1 downstream from said orifice; and wherein said turbine blades are mounted in said passageway at a location 1.5 times D1 downstream from said orifice.

2. The turbine drive apparatus of claim 1 wherein said areas A2 and A1 are related by the ratio A2/A1<0.8.

3. The turbine drive apparatus of claim 1 wherein said passageway provides an unobstructed path between said inlet and said outlet around said turbine for passing debris entering said inlet.

4. A method of propelling a pool cleaner housing through a water pool for collecting debris, said method comprising the steps of:

providing a water passageway in said pool cleaner housing having an inlet of diameter D1 defining a physical entrance area A1 and an outlet having an area equal to or greater than A1;

applying suction to said outlet to pull a water stream through said inlet into said passageway;

forming said inlet to create a vena contracta in said water stream at 1.5 times D1 downstream from said inlet to create a water stream of area A2, where A1>A2;

positioning a turbine blade in said passageway at a location 1.5 times D1 downstream from said inlet while preserving an unobstructed path equal to or greater than area A1 in said passageway for passing debris entering said inlet to said outlet; and employing rotation of said turbine blade to propel said cleaner housing.

5. A pool cleaner apparatus configured to travel adjacent to a wall surface for collecting debris therefrom, said apparatus comprising:

a housing defining a passageway extending between an inlet and an outlet;

said inlet comprising an orifice having a physical cross section area A1 extending through a plate between spaced first and second plate surfaces;

peripheral edge means bounding said orifice for contracting a water stream pulled through said orifice into said passageway to form a vena contracta having a cross section area A2 at a location downstream from said orifice, where A1>A2;

a turbine having blades mounted in said passageway proximate to the location of said vena contracta; and wherein said passageway provides an unobstructed path between said inlet and said outlet around said turbine far passing debris entering said inlet; and wherein said peripheral edge defines a diameter D1 and said vena contracta occurs at 1.5 times D1 downstream from said orifice; and wherein said turbine blades are mounted in said passageway at a location 1.5 times D1 downstream from said orifice.

6. The cleaner of claim 5 wherein said areas A2 and A1 are related by the ratio A2/A1<0.8.

* * * * *